United States Patent [19]

Sauer et al.

[11] 4,431,881

[45] Feb. 14, 1984

[54] PUSHBUTTON DRIVE FOR KEY CONTACTS

[75] Inventors: Heinrich Sauer; Günter Ritthammer, both of Amberg, Fed. Rep. of Germany

[73] Assignee: Siemens Aktiengesellschaft, Munich, Fed. Rep. of Germany

[21] Appl. No.: 448,207

[22] Filed: Dec. 9, 1982

Related U.S. Application Data

[63] Continuation of Ser. No. 226,354, Jan. 19, 1981, abandoned.

[30] Foreign Application Priority Data

Jan. 22, 1980 [DE] Fed. Rep. of Germany ..... 3002169

[51] Int. Cl.[3] ..... H01H 13/62

[52] U.S. Cl. ..... 200/328; 74/527

[58] Field of Search ..... 200/159 R, 323, 328, 200/77, 78, 340; 74/527

[56] References Cited

U.S. PATENT DOCUMENTS

| | | | |
|---|---|---|---|
| Re. 24,496 | 7/1958 | Cornelius | 74/527 |
| 599,245 | 2/1898 | Merrill | 74/527 |
| 2,577,960 | 12/1951 | Ginard | 200/328 |
| 4,182,943 | 1/1980 | Butterworth | 200/159 R |

FOREIGN PATENT DOCUMENTS

| | | | |
|---|---|---|---|
| 2811320 | 9/1979 | Fed. Rep. of Germany | 200/328 |
| 193856 | 1/1965 | Sweden | 200/328 |
| 1235114 | 6/1971 | United Kingdom | 200/328 |

*Primary Examiner*—John W. Shepperd

*Attorney, Agent, or Firm*—Kenyon & Kenyon

[57] ABSTRACT

A pushbutton drive for key contacts is disclosed. The disclosed drive is provided with a mushroom button which is loaded by a restoring force and which includes a mushroom stem movably guided in a housing. The stem has a rest position, and an operating position detent which can be released by rotation of the mushroom button. A detent plunger spring-loaded transversely to the longitudinal direction of movement of the mushroom stem is supported in the housing. Rotation preventing edges or corners formed by intersecting surfaces are provided at the rest position to prevent rotation of the mushroom stem in the rest position. The invention makes undetected use of the switch impossible.

10 Claims, 11 Drawing Figures

PUSHBUTTON DRIVE FOR KEY CONTACTS

This is a continuation, of application Ser. No. 226,354 filed Jan. 19, 1981 now abandoned.

BACKGROUND OF THE INVENTION

The present invention relates to a pushbutton drive for key contacts in which a mushroom button is loaded by a restoring force. More particularly, the drive is of the type in which the stem of the mushroom button is guided movably in a housing and is provided with a rest position, and an operating position detent which can be released through rotation of the mushroom button.

In one known pushbutton drive of the above-described type, a tangible counterforce is overcome when the mushroom button is operated in going from one switch position to another switch position in which the drive becomes latched. After a pressure point is passed, the required force becomes smaller, and the switching process from the one switch position to the other latched switch position takes place automatically with a jump action or characteristic. In such a pushbutton drive, the latched position, for example the operating position detent, can be released by rotation of the mushroom button with the mushroom button returning automatically to the rest position. Basically, this type of pushbutton drive meets the requirements of the trade associations and the Technical Surveillance Association with respect to detection of use if the mushroom button is merely pressed down, since a jump characteristic is obtained by a suitable detent in going from the one switch position to the other latched switch position, as mentioned. If the mushroom button is turned, however, in the release direction before it is pressed down, then the switch can go from one switch position to the other switch position without latching, and detection of use is not possible. For example, an emergency "off" switch can be opened without the pushbutton drive going into the latched operating position.

OBJECT AND SUMMARY OF THE INVENTION

It is an object of the present invention to improve a pushbutton drive of the above-described type such that detection of switching from the contacts closed position to the contacts open position as well as switching from the contacts open position to the contacts closed position is possible.

In a pushbutton drive of the above-described type, this is achieved in a simple manner by preventing rotation of the mushroom button when the drive is in the one switch position, for example, the rest position which is the switch position other than the latched switch position.

According to the invention, one or more detent plungers are spring loaded in the housing transversely to the operating direction of the pushbutton drive. Each plunger is flanked on both sides in the direction of movement of the mushroom stem, at least in the region of the one switch or rest position, by rotation-preventing means associated with the mushroom stem.

The rotation-preventing function according to one aspect of the invention is possible without additional parts since the detent plunger(s) used to latch the switch into the other or latched position can also serve to prevent rotation.

According to another aspect of the invention, the seat of each respective detent plunger on the mushroom stem lies on the same cylinder surface of the mushroom stem both in the latched position of the stem and in the position of the stem after it has been rotated for release thereof. As a result, the mushroom button can be rotated for releasing the pushbutton drive with relatively little force.

With respect to the force necessary for resetting the pushbutton drive, it is advantageous if the surface of the mushroom stem which is in contact with the detent plunger after the mushroom button is pressed down and rotated, merges in the operating direction with the adjacent surface of the mushroom stem.

To prevent the mushroom stem from rotating except in the region of the operating position detent, the detent plunger can advantageously be formed by a slider which has sharp edges or corners in the area of the rotation-preventing means. Also, the detent plunger head can advantageously be curved in the operating direction and the rest position detent can be formed in part by a surface sloped at an angle, for example about 45°. Such an arrangement for the detent plunger and rest position detent, which determines the jump behavior for the pushbutton drive, has been found to have suitable operating characteristics.

More particularly, the invention provides an improvement in a pushbutton drive for key contacts including a mushroom button loaded by a restoring force and having a mushroom stem which is movably guided in a housing and is provided with a rest position, and an operating position detent which can be released by rotation of the mushroom button. The improvement according to the invention comprises a detent plunger spring-loaded transversely to the longitudinal direction of movement of the mushroom stem and disposed in the housing for engaging the mushroom stem, the mushroom stem including rotation preventing means on both sides of the detent plunger at least in the region of the rest position for preventing rotation of the mushroom stem thereat. The mushroom stem includes a rest position surface associated with the rest position, an operating position detent surface associated with the operating position detent and another surface extending adjacent to the rest position surface and the operating position detent surface into which the detent plunger extends after the mushroom stem is rotated from the operating position detent.

In a disclosed embodiment, the rotation preventing means comprises spaced surfaces intersecting the rest position surface and the detent plunger extends between the spaced surfaces when the mushroom stem is in the rest position. Preferably, the spaced surfaces intersect the rest position surface at about a right angle and the other surface of the mushroom stem which is in contact with the detent plunger after the mushroom stem is rotated, merges into an adjacent surface of the mushroom stem along a direction of movement of the mushroom stem. Also, the detent plunger preferably includes a slider having corners in the region of the rotation-prevention means and a surface curved in the direction of the movement of the mushroom stem which comes into contact with the mushroom stem. The mushroom stem includes an inclined surface adjacent to the rest position surface at which the rest position terminates, which, as mentioned, is preferably inclined at about a 45° angle.

An intermediate detent can be provided between the rest position detent and the operating position detent and arranged so that the current is interrupted before the intermediate detent snaps in. This provides the advantage of short operating travel after the pressure point has been passed, such that direct resetting of the mushroom button is not possible. Associating a partition with the intermediate detent prevents the detent plunger from running into the intermediate detent when the mushroom button is being moved from the operating position to the rest position, i.e. being reset, makes it impossible to approach the intermediate detent during resetting.

These and other aspects of the invention will be more apparent from the following description of the preferred embodiment thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
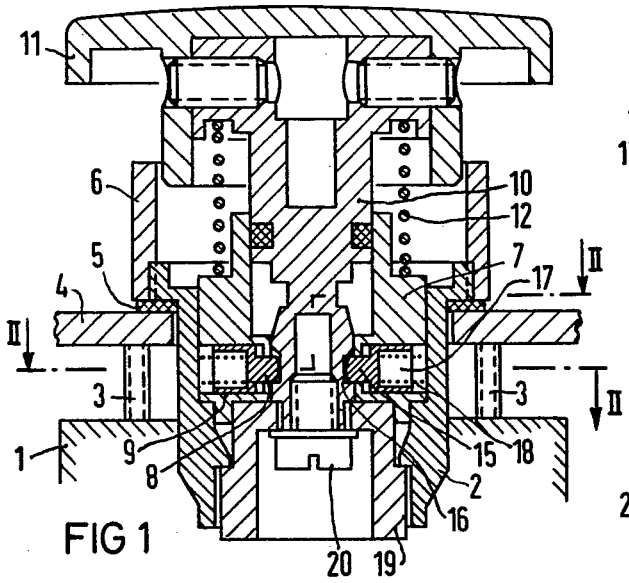
FIG. 1 is a side view in cross section through the pushbutton drive according to the invention.

Referring more particularly to the drawings, a pushbutton drive for operating key contacts 1 (shown symbolically in FIG. 1) is illustrated. In a conventional manner, the key contacts 1 are connected to the housing 2 of the pushbutton drive via a bayonet connection (not shown), and are fastened to the front panel 4 via screws 3. A seal denoted by 5 and a front ring denoted by 6 serve as an abutment for the pushbutton drive. The housing 2 is equipped with an insert 7 having openings 9 into which detent plungers 8 are mounted. The insert 7 also guides the mushroom stem 10 of a mushroom button 11. An actuator extension 19 (FIG. 1) is fastened by a screw 20 to the mushroom stem 10.

Figure 2:
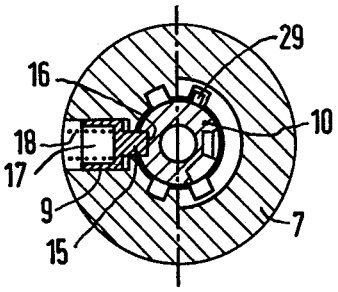
FIG. 2 is a cross-sectional view taken along line II—II of the pushbutton drive of FIG. 1.
Figure 3:
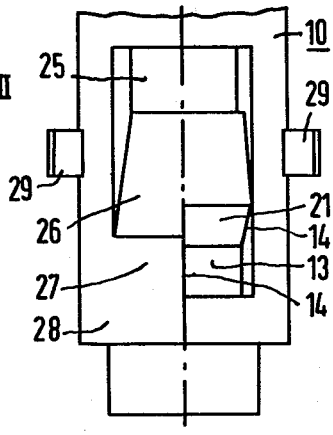
FIG. 3 is a cross sectional view of the mushroom stem and detent plunger of the pushbutton drive of FIG. 1 in the area of the detent and resetting surfaces.

A torsion-compression spring 12 having rotary and longitudinal spring action acts to restore the mushroom button 11 to the rest position in which the contacts are closed as shown in FIG. 1, the mushroom stem 10 being equipped with guide ribs 29 (FIGS. 2-3) to confine the rotary motion of the stem within predetermined limits.

Recessed rest position detent surfaces 13 are arranged for example, diagonally opposite to each other. A rotation-prevention surface 14 is disposed perpendicular to the rest position detent surface 13 at each side thereof to prevent rotation of the mushroom button 11 in the FIG. 1 rest position. The detent plunger 8 is equipped with a square cross-sectioned extension part 15 having corners and a rounded tip whose rounded surface is denoted by 16. The extension part 15 is engaged within the depression formed by the recessed rest position detent surface 13. A cavity 17 in the detent plunger 8 receives a detent spring 18.

Figure 4:
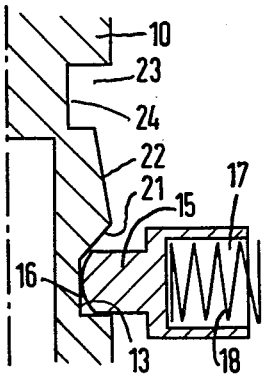
FIGS. 4 to 8 are cross-sectional views of the mushroom stem and the detent plunger of the pushbutton drive of FIG. 1 showing different relationships of the detent plunger and the detent surfaces.
Figure 5:
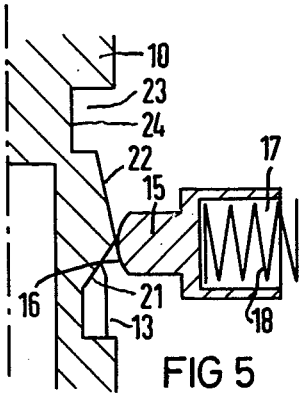
Figure 6:
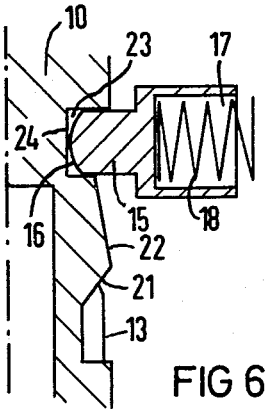

Adjacent to the rest position detent surface 13 on the stem, as shown in FIG. 3 and FIGS. 4 to 8, are an inclined surface 21, which cooperates with the rounded surface 16 of the detent plunger extension, and an inclined surface 22 which aid in bringing about the forced jump action of the pushbutton switch. Surface 21 is preferably inclined at a 45° angle. Surface 22 slopes oppositely to the inclined surface 21 towards a recess 23 in which a recessed surface 24 is disposed. The jump action is brought about when the rounded surface 16 moves from the surface 21 over a "pressure point" to the surface 22 so that the detent plunger 8 springs with its extension part 15 into the recess 23 which corresponds to the operating (contacts open) position detent of the switch. This position is illustrated in FIG. 6.

On the same surface of the mushroom stem as the recess surface 24 of the recess 23 is a surface 25. The rounded surface 16 of the detent plunger extension 15 can be brought into contact with surface 25 by rotating the mushroom button when the detent plunger extension is in the recess 23. A slightly sloped surface 26 is disposed adjacent to the surface 25 so that when the mushroom button has been rotated from the operating position of FIG. 6 to the rotated position shown in FIG. 7, the mushroom stem is restored to the FIGS. 1 and 4 rest position under the rotary and longitudinal spring action of the spring 12. Rotating the mushroom button from the operating position of FIG. 6 brings the detent plunger 8 into the region 27 (FIG. 3) of the surface 28 of the mushroom stem 10. The detent plunger 8, upon the stem 10 being restored to the FIG. 1 position in which the plunger contacts surface 13, prevents rotation of the stem 10 in cooperation with the sharp corners formed by surfaces 14 with surface 13.

Figure 7:
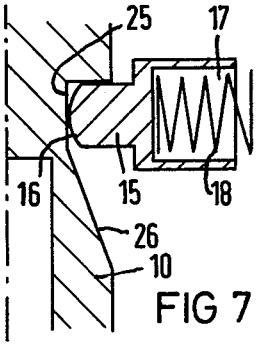
Figure 8:
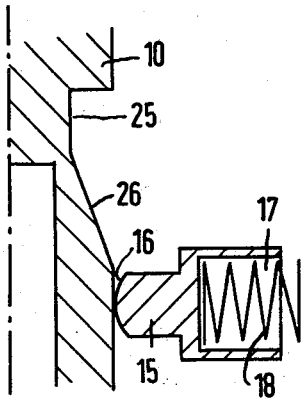

FIG. 4 shows the rest (contacts closed) position of the pushbutton drive. In FIG. 5, the pressure point, i.e., an intermediate point between surfaces 21 and 22, is being passed. FIG. 6 shows the operating (contacts open) position of the pushbutton drive. In FIG. 7, restoring of the pushbutton drive to the rest position of FIG. 4 is being initiated through rotation of the mushroom button. The FIG. 7 position can be called the release position in that the stem 12 is released to be restored to the rest position under the action of spring 12. FIG. 8 shows the mushroom button as it is being restored or reset to the rest position by rotation of the mushroom pushbutton by the rotary action of the spring.

Figure 9:
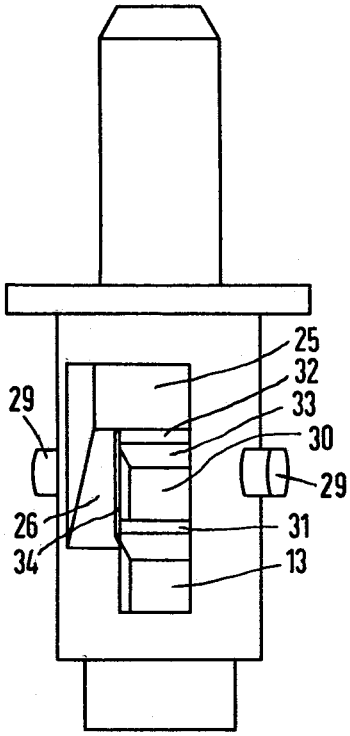
FIGS. 9 to 11 are a top view, longitudinal section and cross section respectively of a mushroom stem according to another embodiment of the invention in which an additional intermediate detent is provided.
Figure 10:
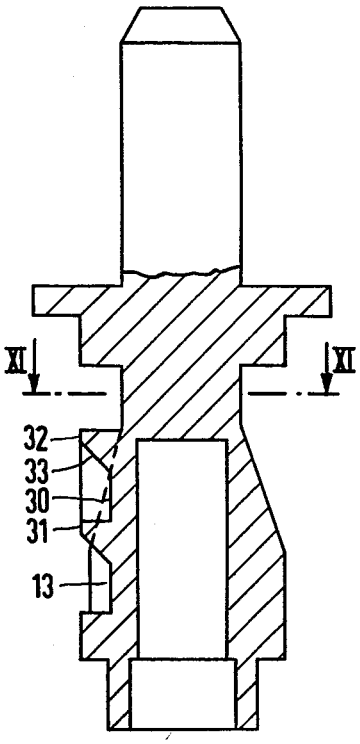
Figure 11:
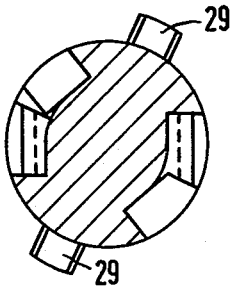

In the embodiment according to FIGS. 9 to 11, shorter travel distances can be obtained. A further detent recess or depression 30 between the rest position detent surface 13 and the operating position detent surface 25 is provided as an intermediate detent, into which the detent plunger 8 snaps after passing the detent edge 31. The detent depression 30 is arranged so that when the detent plunger 8 snaps in, the interruption of the current, i.e., the actuation of the break contact, has already taken place. Upon further motion of the mushroom button 11 by the momentum of one's hand, a run-up surface 33 is traversed, the detent peak 32 is passed and the detent plunger 8 moves into the area 25. Resetting is carried out in the manner described for the arrangement according to FIGS. 1 to 8. In order to prevent snapping of the detent plunger 8 from the rising surface 26 into the detent depression 30 when the mushroom stem is being restored to the rest position, a partition 34 is provided which defines the detent depression at a fourth lateral surface.

According to the invention, detection of operation of the switch in going from the rest position to the operating position is possible, and operation of the switch in going from the rest position to the operating position is not possible without the detent plunger passing over surface 21. In other words, the mushroom stem can not be rotated in the rest position. Due to the jump characteristic of the switch, the position of the break contact can be controlled during operation in the region of inclined surface 22 because rotation of the mushroom button is possible in that region but not in the region of surface 13.

The advantages of the present invention, as well as certain changes and modifications of the disclosed embodiment thereof, will be readily apparent to those skilled in the art. It is the applicants' intention to cover by their claims all those changes and modifications which could be made to the embodiments of the invention herein chosen for the purpose of the disclosure without departing from the spirit and scope of the invention.

What is claimed is:

1. A pushbutton drive for key contacts comprising a housing, a mushroom button having a mushroom stem which is movably guided in the housing between a rest position and an operating position, a detent plunger spring-loaded transversely to the longitudinal direction of movement of the mushroom stem and disposed in the housing for engaging the mushroom stem, an operating position detent disposed on the mushroom stem and cooperating with the detent plunger for latching the mushroom stem in the operating position and for allowing the mushroom stem to be released from the operating position upon rotation of the mushroom stem in the operating position, a rest position detent disposed on the mushroom stem and cooperating with the detent plunger to latch the mushroom stem in the rest position, the rest position detent including spaced rotation preventing surfaces disposed on the mushroom stem cooperating with the detent plunger for preventing rotation of the mushroom stem in the rest position, the mushroom stem having surface configuration cooperating with the detent plunger for providing the mushroom stem with a jump action as the mushroom stem is moved from the rest position detent to the operating position detent, means for loading the mushroom stem with a restoring force including a torsional component to urge the mushroom stem from the operating position to the rest position, a rest position detent surface associated with the rest position detent which is disposed between the rotation preventing surfaces, the detent plunger contacting the rest position detent surface in the rest position, an operating position detent surface associated with the operating position detent, the detent plunger contacting the operating position detent surface in the operating position, means for restoring the mushroom stem to the rest position detent from the operating position detent comprising another surface extending along the mushroom stem from adjacent the rest position detent surface to adjacent the operating position detent surface, the other surface intersecting the operating position detent surface such that the detent plunger can slide from the operating position detent surface to the other surface to allow the mushroom stem to be rotated in the operating position and intersecting one of the rotation preventing surfaces of the rest position detent to allow the detent plunger to enter the rest position detent from the other surface under the action of the means for loading.

2. The drive according to claim 1 wherein said surface configuration of the mushroom stem for providing the mushroom stem with a jump action comprise a first surface portion inclined radially outwardly from the rest position detent extending axially along the mushroom stem toward the operating position detent and a second surface portion intersecting the first surface portion and inclined radially inwardly therefrom and extending from the first surface portion axially along the mushroom stem to the operating position detent, the first and second surface portions and the detent plunger cooperating to give the mushroom stem said jump action as the mushroom stem is moved from the rest position detent to the operating position detent.

3. The drive according to claim 1 wherein the other surface of the mushroom stem comprises three surface portions, a first surface portion being adjacent to and intersecting the operating position detent surface, a second surface portion intersecting the first surface portion inclined outwardly therefrom and extending axially along the mushroom stem towards the rest position detent, and a third surface portion intersecting the second surface portion and extending axially along the mushroom stem toward the rest position detent, the third surface portion extending adjacent to the rest position detent surface and intersecting said one rotation preventing surface at about a right angle.

4. The drive according to claim 1 wherein the spaced rotation preventing surfaces intersect the rest position detent surface at about a right angle.

5. The drive according to claim 1 wherein the detent plunger includes a slider having corners adapted to being engaged by the rotation preventing surfaces.

6. The drive according to claim 1 wherein the detent plunger includes a surface curved along the direction of movement of the mushroom stem which comes into contact with the mushroom stem.

7. The drive according to claim 1 wherein the rest position detent includes a surface for preventing longitudinal movement of the mushroom stem out of the rest position in a direction away from the operating position.

8. The drive according to claim 1 wherein the operating position detent includes a surface which prevents longitudinal movement of the mushroom stem out of the operating position in a direction away from the rest position.

9. A pushbutton drive for key contacts comprising a housing, a mushroom button having a mushroom stem which is movably guided in the housing between a rest position and an operating position, a detent plunger spring-loaded transversely to the longitudinal direction of movement of the mushroom stem and disposed in the housing for engaging the mushroom stem, an operating position detent disposed on the mushroom stem and cooperating with the detent plunger for latching the mushroom stem in the operating position and for allowing the mushroom stem to be released from the operating position upon rotation of the mushroom stem in the operating position, a rest position detent disposed on the mushroom stem and cooperating with the detent plunger to latch the mushroom stem in the rest position, the rest position detent including spaced rotation preventing surfaces disposed on the mushroom stem cooperating with the detent plunger for preventing rotation of the mushroom stem in the rest position, means for loading the mushroom stem with a restoring force including a torsional component to urge the mushroom stem from the operating position to the rest position, a rest position detent surface associated with the rest position detent which is disposed between the rotation preventing surfaces, the detent plunger contacting the rest position detent surface in the rest position, an operating position detent surface associated with the operating position detent, the detent plunger contacting the operating position detent surface in the operating position, means for restoring the mushroom stem to the rest position detent from the operating position detent comprising another surface extending along the mushroom stem from adjacent the rest position detent surface to adjacent the operating position detent surface, the other surface intersecting the operating position detent surface such that the detent plunger can slide from the operating position detent surface to the other surface to allow the mushroom stem to be rotated in the operating position and intersecting one of the rotation preventing surfaces of the rest position detent to allow the detent plunger to enter the rest position detent from the other surface under the action of the means for loading, and an intermediate position detent disposed on the mushroom stem between the rest position detent and the operating position detent and positioned so that current is interrupted upon snapping of the detent plunger therein when the mushroom stem is moved from the rest position to the intermediate position.

10. The drive according to claim 9 and including a partition associated with the intermediate detent which prevents the detent plunger from running into the intermediate detent when the mushroom stem is being moved from the operating position to the rest position.

* * * * *